United States Patent [19]

McCarthy

[11] Patent Number: 4,660,334

[45] Date of Patent: Apr. 28, 1987

[54] THETA BLAST CELL

[76] Inventor: Walton W. McCarthy, 44 Buttonwood Dr., Auburn, N.H. 03032

[21] Appl. No.: 783,088

[22] Filed: Oct. 2, 1985

[51] Int. Cl.[4] ..... E02D 27/00

[52] U.S. Cl. ..... 52/169.6; 109/1 S; 285/224; 182/52

[58] Field of Search ..... 109/1 BS; 52/169.5, 52/169.1, 169.6; 182/52, 51; 285/224

[56] References Cited

U.S. PATENT DOCUMENTS

| | | | |
|---|---|---|---|
| 312,908 | 2/1885 | Shickle | 182/52 |
| 744,199 | 11/1903 | Hubbell | 52/169.5 |
| 955,794 | 4/1910 | Harry | 52/199 |
| 1,349,663 | 8/1920 | Cumfer | 285/224 |
| 3,138,124 | 6/1964 | Baier | 52/169.6 |
| 3,159,117 | 12/1964 | Rosenfeld | 52/169.5 |
| 3,164,111 | 1/1965 | Lanni | 52/169.6 |
| 3,891,248 | 6/1975 | Kannapell et al. | 285/224 |

FOREIGN PATENT DOCUMENTS

| | | | |
|---|---|---|---|
| 892511 | 10/1953 | Fed. Rep. of Germany | 52/169.6 |

*Primary Examiner*—James L. Ridgill, Jr.
*Attorney, Agent, or Firm*—Leonard Belkin

[57] ABSTRACT

An underground blast shelter for providing short and long term protection against nuclear detonations for its occupants. The shelter consists of a cell to house the occupants and a command station interfacing with the ground surface. The cell and command station are vertically and horizontally spatially separated with vertical and horizontal shafts providing communication between the two. Provision is made to give protection to the occupants from blasts, overpressure, surface fires, radiation, chemical and biological warfare agents.

11 Claims, 7 Drawing Figures

FIG. 3
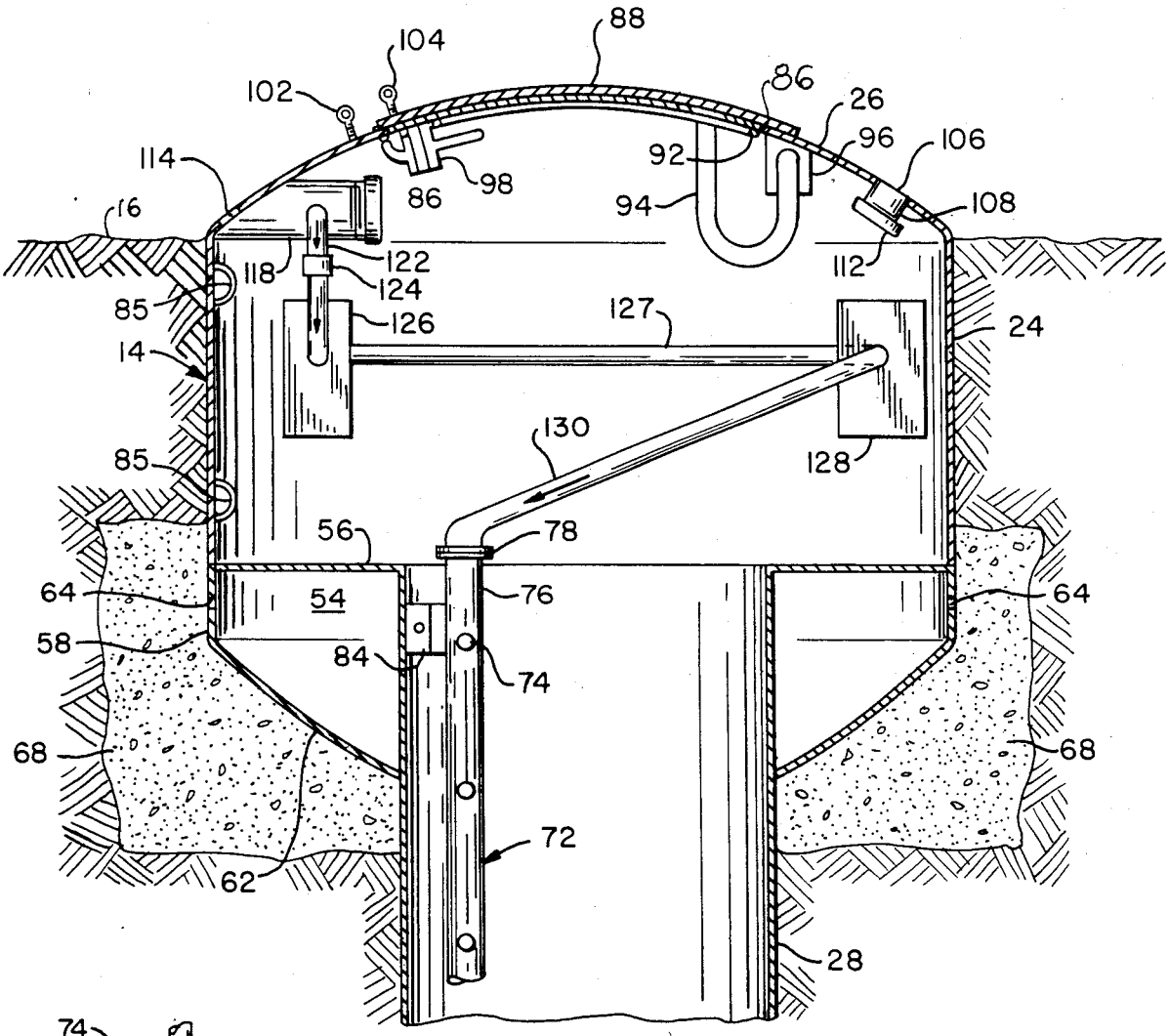
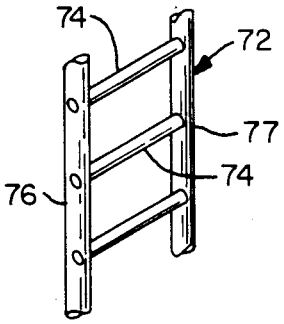
FIG. 3b

THETA BLAST CELL

BACKGROUND OF THE INVENTION

This invention relates to a blast shelter and more particularly to a personal blast shelter capable of providing improved protection during and after the detonation of nuclear weapons.

In spite of a large amount of misinformation which has been presented to the public, there is convincing scientific and technical information available that it is possible for most people to survive on both a short and long term basis a full scale exchange of nuclear weapons provided that proper advance preparations are made.

It is acknowledged that it would be a moot point that an individual survive such a nuclear holocaust if as a result all life on earth were doomed to extinction or marginal existence. However, in 1975 and 1985 the National Academy of Sciences (NAS) produced extensive reports on the atmospheric effects from various war scenarios which contradict any such idea. In the 1975 report, NAS envisioned an exchange of 550 to 1000 weapons with a yield of 20 megatons (MT) as surface bursts and the simultaneous detonations of 4000 to 5000 weapons of 1 to 2 MT yield also detonated as surface bursts. In the 1985 report, the scenario suggested that about 6500, or one half the world arsenal, would be detonated, of which 1500 MT would be detonated at ground level and the other 5000 MT at altitudes chosen so as to maximize blast damage to structures. Targets for the above detonations would not only include those purely of a strategic nature such as missile silos, strategic air forces, key military bases, etc., but also manufacturing and electric power plants, petroleum refineries, and other targets associated with large urban areas, so it has to be presumed that all major cities in the United States would be targeted.

Careful analysis presented in the above reports and other information of a scientific and technical nature which is available show that the results of such detonations can be divided into immediate and longer time effects, and that these effects can be further divided into discrete and readily quantifiable conditions which can be dealt with effectively to insure long term survivability of the individual and the community.

Attempts up to now to produce shelters capable of providing such survival have unfortunately been inhibited by the growth of myths surrounding the results of a nuclear war. For example, in a book entitled "Nuclear Madness", the author states "A 1000 megaton device exploded in outer space could devastate an area the size of the western states". There are no weapons in existence even the size of 100 MT, and it is not conceivable based upon the potential effectiveness of such a weapon that one of that size would even be built. The scientific fact is that when weapon yield increases by a factor of 10, the danger radius only doubles. A 100 MT device would only have a danger radius twice that of a 10 MT weapon. Consequently, due to the law of diminishing returns on bomb size, it is seen that there are practical limits on bomb size and this is a major factor which indicates that it is possible to produce a shelter which is effective regardless of bomb size, provided certain other problems can be solved.

In a book entitled "Freeze", the statement is made "No previous war, no volcano, no earthquake, no plague has ever posed the type of threat to our civilization and our planet as does a general nuclear war". The bubonic plague killed over 25 million people, about 25 percent of the population of Europe. There were more dead bodies than the living could bury. In World War II, over 1700 Soviet cities were destroyed with over 20 million people. In addition, the earth has suffered major famines in which large portions of the population died, as for example, 20 million Russians in 1920 and 50 million Chinese in the period between 1848 and 1864. In fact, the state of technology today is such that the human population is much better equipped to meet the calamity of a nuclear war than the populations which suffered the disasters noted above.

In reality, the question today is not whether persons can survive a nuclear holocaust but whether people have the will and determination to prepare for survival.

Some efforts have been made to prepare shelters capable of providing some degree of protection in the event of a nuclear blast or multiple detonations. Basically, most such shelters have been designed to afford a measure of protection from fallout. However, the fallout shelter provides no blast protection, nor will it give any protection against any number of certain other surface effects, such as, a burst of nuclear radiation, the fireball which can reach millions of degrees Fahrenheit, thermal radiation which is heat transmitted from the fireball, fire storms produced by the thermal radiation, pressure waves (both under and over pressure), and blast wind.

During the first minute after detonation of a nuclear weapon, there will be a burst of radiation in which neutrons and gamma rays are of main concern. The intensity of this radiation drops off rapidly with distance from ground zero, and at a distance of four miles the total dose is virtually zero for any size weapon up to 20 MT. In addition, the gamma radiation is reduced by a factor of 1000 in passing through 55 inches of earth, while for neutron radiation this reduction takes place in 47 inches of earth.

The fireball, which lasts for less than 90 seconds, reaches temperature levels millions of degrees Fahrenheit. The radius of the fireball is up to 2.2 miles for a 20 MT weapon detonated in an air burst and 3.0 miles in a surface burst. It is anticipated that an underground shelter not within the radius of the fireball will survive the fireball if properly designed.

Thermal radiation is felt as heat resulting from the fireball. Thermal radiation, which will ignite combustible material withn a limited distance from ground zero, drops off rapidly with distance and is further attenuated by the scattering effect of the atmosphere. This radiation travels at the speed of light so that it appears virtually instantaneously. The fires caused by the thermal radiation do continue for a significant period of time and a properly designed shelter should be able to accommodate such a condition on the ground surface.

The effect of the blast itself is to produce shock or pressure waves followed by a blast wind. These destructive forces damage or destroy surface structures to a degree depending on size of the weapon, distance from ground zero, and the type of construction. In the case of an underground shelter, the effect of principal concern is that due to increases and decreases in pressure since all shelters have some communication with ground level and there will be a transfer of forces to the shelter structure and to the persons within the shelter. For example, overpressure can cause rupture of ears, lungs, and stomach, and an air embolism in the heart and brain. It is thus essential for the shelter to protect the occupants from such effects.

The fallout is dirt and debris from the crater of a nuclear explosion which enters the fireball and is fused, vaporized and made radioactive. It is then drawn up into the stem of the mushroom cloud and reaches a high altitude and soon begins to fall back to earth as "fallout". The shelter must protect its occupants from the radioactive components of the fallout.

A hopeful fact when considering the effects of fallout is that the basic requirements for human survival, namely, water, air and food cannot themselves become radioactive from fallout. These essential elements can and do become contaminated with radioactive impurities which, however, can be removed.

Some back yard, underground shelters have been developed, but they lack adequate protection against the effects of nuclear weapons as described above plus protection against intruders. The latter is likely to be a severe problem in the event of a nuclear exchange and must be taken into account in any proper shelter design.

The back yard, or personal, shelter has the capability of providing shelter for a small number of people, such as a family unit and incorporates features to protect its occupants against the effects of nuclear weapons. But provision must also be made for taking in air and venting, and permitting access to the shelter. However, vents and access ports make it possible for intruders to flush out the occupants with the use of gasoline, water, fire, etc., as well as perhaps using a vehicle to force open the hatch. Current shelter designs do not give adequate attention to this aspect of the problem.

SUMMARY OF THE INVENTION

This invention is concerned with a shelter capable of producing survival for its occupants during and after one or more nuclear blasts regardless of where detonation takes place except if the shelter is within or close to the crater formed by a surface blast. By survival herein is meant not only survival from the initial effects of the blast but also longer term effects, for at least 41 days and up to a year or longer.

Rigorous analysis of the effects of nuclear detonations indicates that a shelter designed to insure survival of its occupants must cope successfully with a variety of short and long term direct and indirect effects flowing therefrom briefly discussed or alluded to above.

Such a shelter incorporating the principles of this invention is capable of resisting the effect of blast, large doses of neutron and gamma radiation, ground shock, and overpressure of at least 100 psi. In addition, the shelter is capable of protecting its occupants from a variety of other potential, dangerous effects, such as water build up within the shelter and uplifting force due to buildup of water under and around the shelter, radioactive fallout material, underpressure, chemical and bacteriological warfare agents which an enemy might deliver following a nuclear exchange, and aggressive, hostile acts by persons attempting to gain access to the shelter.

A preferred embodiment of an underground shelter constructed in accordance with the principles of this invention consists of a cell containing a living area for the occupants of the shelter and a command station having a dome at ground level for providing access to the shelter. The command station is displaced both horizontally and vertically from the cell and contains not only the hatch for entering and leaving the shelter, but provision for exchanging air with outside of the shelter, proper filtering of incoming air, and discharge of liquid waste products of the shelter into a cesspool.

Communication between the living cell and the command station utilizes an entranceway which is generally L-shaped. The vertical section of the entranceway incorporates features to absorb forces due to blast effect on the exposed portion of the command station. The command station incorporates other features designed to protect the occupants of the shelter from other effects of the nuclear blasts and the aftermath plus protection against intruders who may wish to gain access to the shelter using force. The shelter includes features designed to insure that the occupants will not only survive the detonations of the nuclear weapons but also insure that they can remain and function adequately within the shelter until such time as they are able to emerge and function outside of the shelter.

The use of a dome to close off the command station at ground level is also applicable for use with an air vent from a shelter that is not equipped with a station. In this embodiment, the vent terminates within the dome and provision is made to prevent access by an intruder and entry of water due to flooding into the vent.

It is thus an object of this invention to provide a nuclear shelter which is capable of protecting its occupants against the short and long term effects of nuclear detonations and at the same time provide a secure living environment until it is safe to emerge.

Another object is to provide a closure for an air vent in a shelter to protect the occupants against intrusion.

Other objects and advantages of this invention will hereinafter become obvious from the following description of preferred embodiments of this invention.

BRIEF DESCRIPTION OF THE DRAWINGS

FIG. 3 is an enlarged detail in section partially schematized of the command station seen in FIG. 1 showing details of the air inlet system.

FIG. 3*b* is an isometric view of a portion of the ladder.

DETAILED DESCRIPTION OF THE PREFERRED EMBODIMENTS

Figure 1:
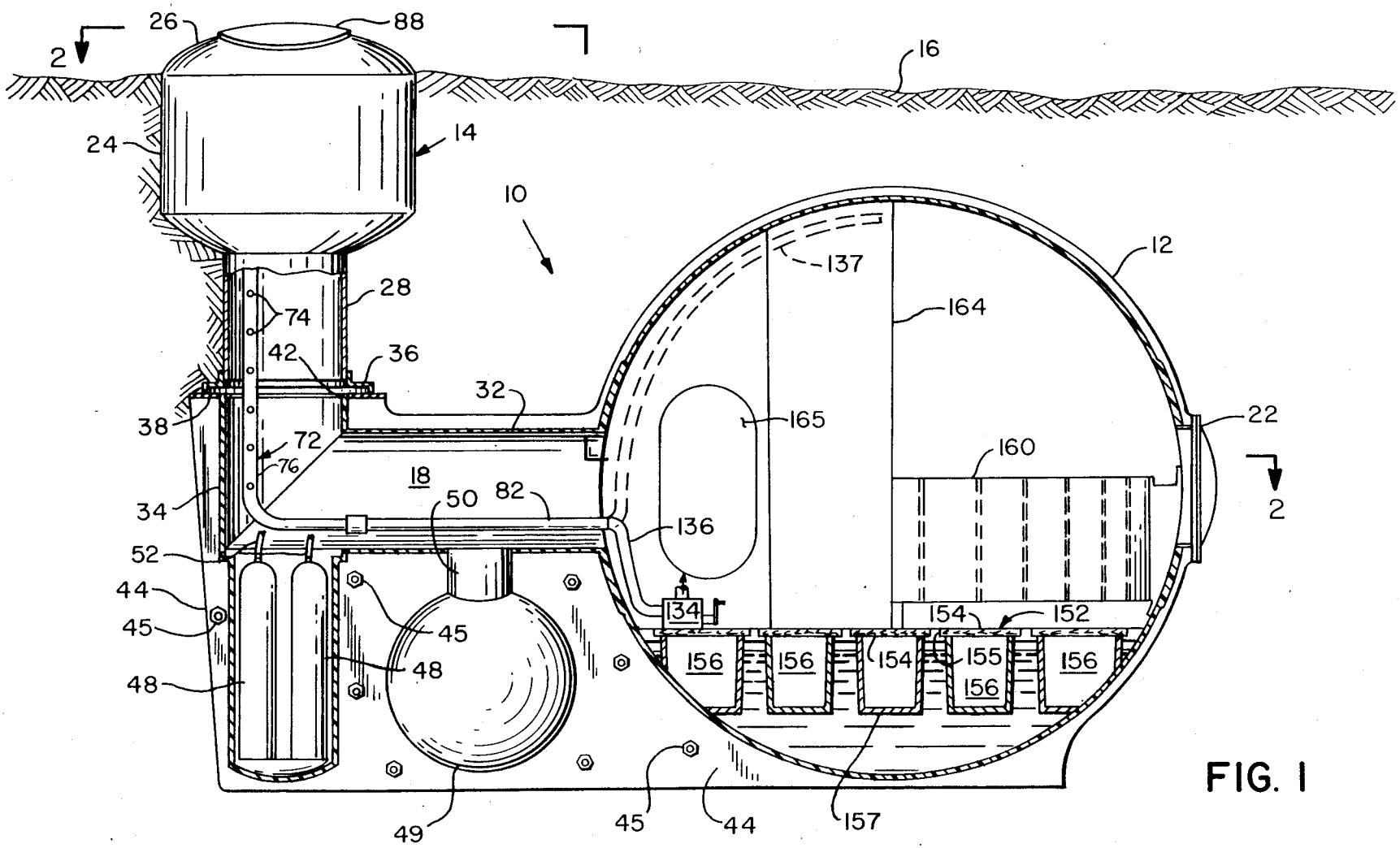
FIG. 1 is an elevation view in section partially schematized of a shelter in place constructed in accordance with the principles of this invention.
Figure 4:
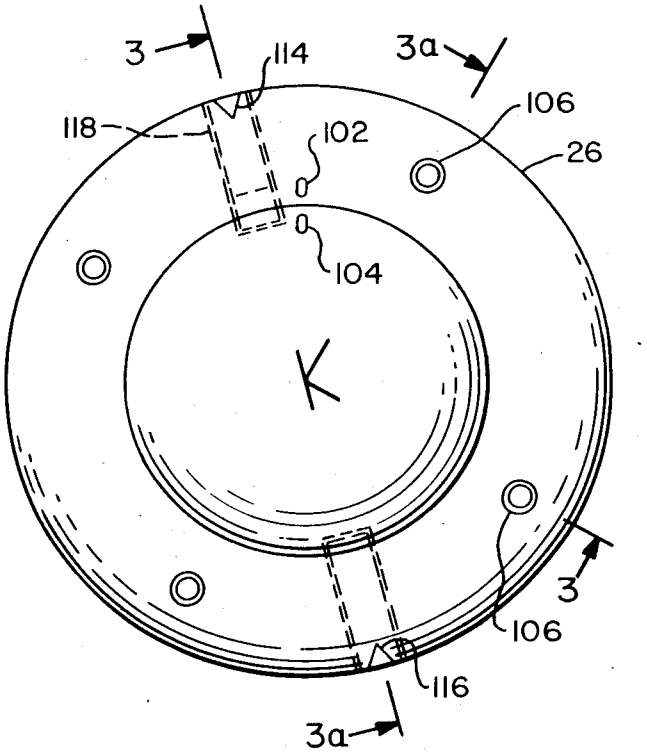
FIG. 4 is a plan view of the dome exposed on the ground surface showing the manifolds in relation to the triangular openings.
Figure 2:
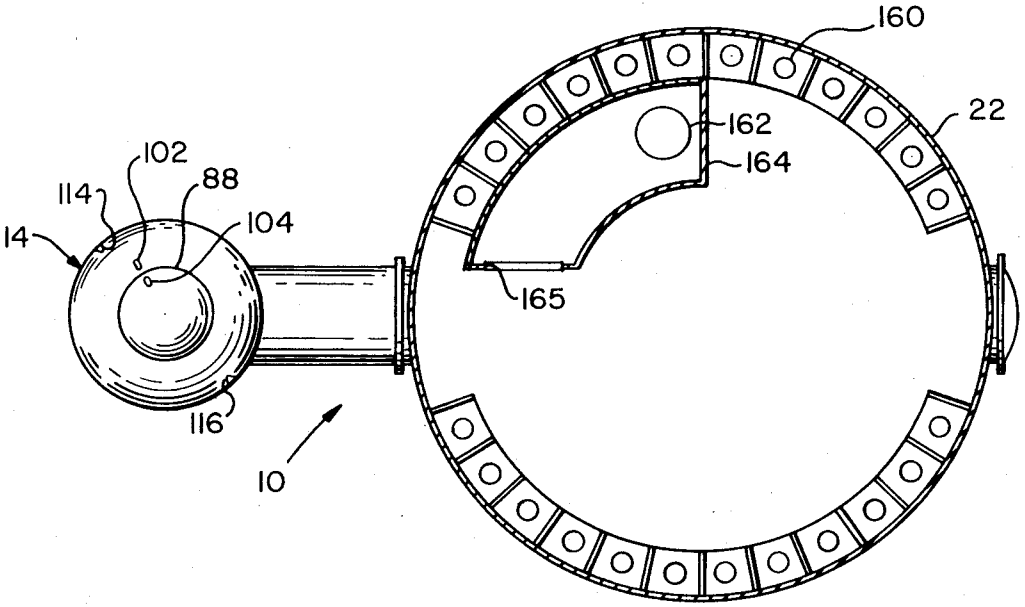
FIG. 2 is a partially schematized plan view of the shelter with a section through the cell.

Referring to FIGS. 1–4, there is shown a nuclear blast shelter 10 consisting of a spherical living cell or containment 12, a command station 14 interfacing with ground level 16, and an entranceway 18 providing communication between station 14 and cell 12.

Cell 12, which can be in any convenient shape, such as spherical as illustrated, is located sufficiently below surface level 16 so as to provide adequate protection for the occupants within from the effects of neutron and gamma radiation issuing from the nuclear weapon at the time of detonation. This would depend in part on the composition and density of the soil plus any shielding added to cell 12 itself.

The spherical configuration of cell 12 is particularly resistive to any blast forces transmitted from surface 16 through the soil downwardly or at an angle. The configuration permits the cell to flex inwardly to absorb those forces.

Along the side of cell 12 is one or more hatch covers 22 for the purpose of being able to join together, if desired, more than one cell 12. However, command station 14, to be described, is designed to service a single cell 12, and each adjoining cell would have its own command station.

Command station 14 consists of a cylindrical module 24 with a dome 26 exposed above surface 16, a vertical shaft 28 of smaller diameter extending downwardly, and a horizontal shaft 32 connecting the bottom of shaft 28 with cell 12. Command station 14 is situated so that only dome 26 is exposed. Command station 14 and its vertical shaft 28 are of steel construction.

It will be noted that just above the elbow 34 formed by vertical and horizontal shafts 28 and 32, the former terminates in an annular flange-type member 36 resting on a horizontal plate 38 with an opening 42 which supports a downwardly extending flange or plate 44. Flange 44 may be constructed from matching pieces held together by bolts 45. The purpose of this configuration is to absorb any downward blast force on dome 26 without damaging shafts 28 or 32 causing either of them to be made unusable or to become detached from cell 12. Flange-type member 36 acts like a flexible joint since it is designed to absorb a substantial downward force. Command station 14 as a whole unit is prevented from excessive downward movement by overpressure due to its much larger diameter as compared to shaft 28. The small amount of downward vertical movement is absorbed by the flexible joint on the bottom of vertical shaft 28. This design results in no stress or shock wave being transmitted to cell 12. Flange-type member 36, plate 38, horizontal shaft 32, flange 44 and cell 12 are all preferably made from fiber glass.

Fuel and air tanks 48 would be located within the soil below shaft 32 mounted in cut-outs in flange 44 with connecters 52 to the interior of the former. Spherical water tank 49 with a hatch connector 50 similarly penetrate flange 44. Module 24, vertical shaft 28, and horizontal shaft 32 serve as the entranceway to cell 12.

Figure 3A:
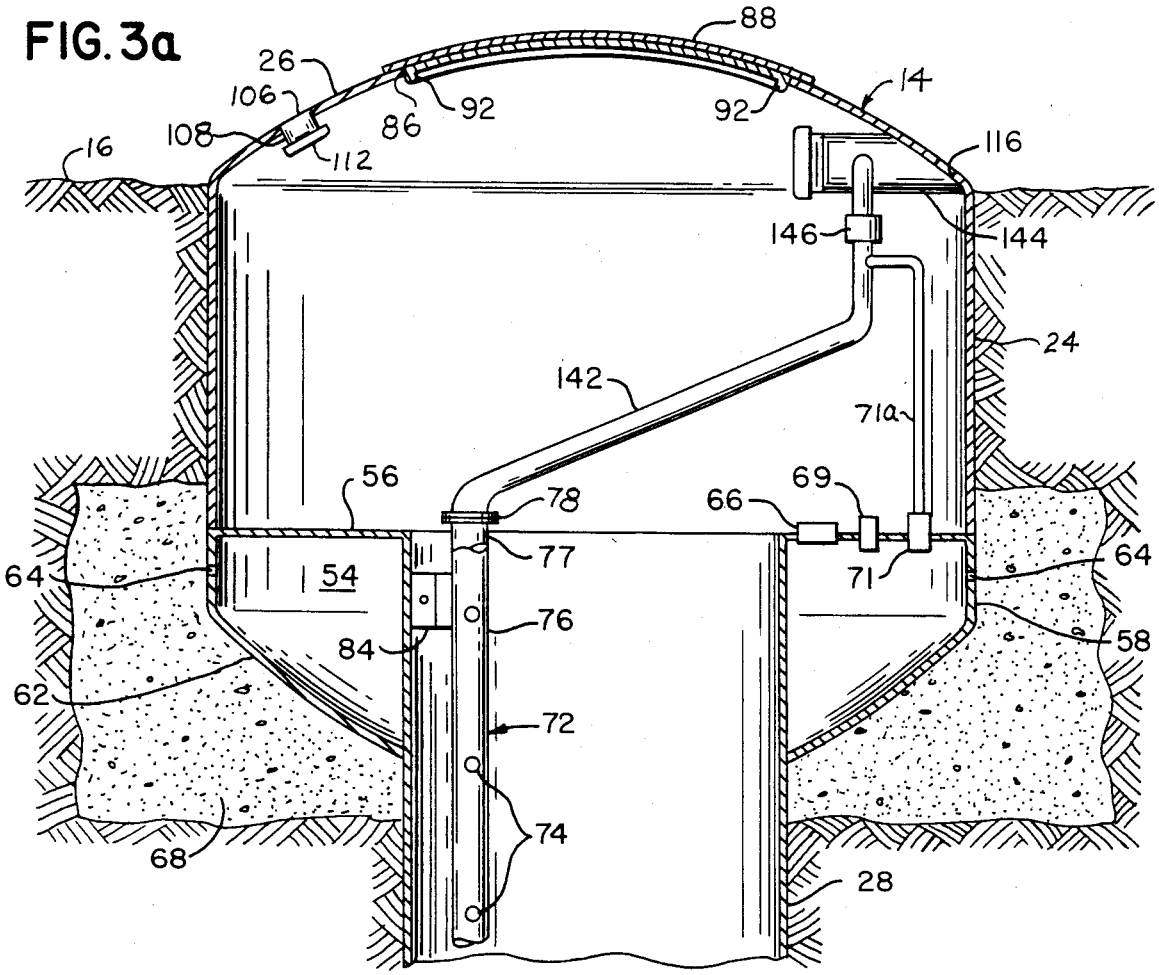
FIG. 3*a* is an enlarged detail of the command station partially schematized showing the air outlet system.

Module 24, as best seen in FIGS. 3 and 3*a*, forms with vertical shaft 28 an annular chamber 54 bounded on the inside by shaft 28, on the top by a horizontal wall 56, on the outside by side wall 58 of module 24, and on the bottom by an annular, curved wall 62. Chamber 54 is fully enclosed except for a row of openings 64 near the top and an inlet pipe 66 so that chamber 54 serves as a leaching cesspool for shelter 10. Sewage is pumped into chamber 54 through inlet pipe 66 and the liquid overflow passes out through openings 64. Connecting hoses (not shown) would be employed. Depending on the condition of the soil, a bed 68 consisting of gravel may surround shaft 28 and chamber 54. Pipe 69 permits pumping out of the sewage while pipe 71 permits venting through conduit 71*a* to conduit 142. The views in FIGS. 3 and 3*a* are offset along different diameters above wall 54 to permit the air inlet and outlet systems to be shown clearly.

Within the entranceway including command station 14, vertical shaft 28, and horizontal shaft 32, there is mounted a ladder assembly 72 consisting of a vertical section with rungs 74 and a pair of hand rails 76 and 77 terminating in module 24 at 78, and a lower horizontal section 82 terminating at the entrance to cell 12. Within horizontal shaft 32 ladder assembly 72 acts as a guide with the side rails to be grasped by an occupant moving between the side rails. The vertical section functions as a stepladder for the movement up or down of the occupant. The side rails are hollow and act as pipes in the air inlet/outlet system to be described further below. It is understood that ladder assembly 72 will be supported by an adequate number of supports 84. Handles 85 are provided for use by occupants climbing ladder assembly 72.

Dome 26 of module 24 has a circular opening 86 which is closed by a hatch cover 88 which conforms to the shape of dome 26. Hatch cover 88 is provided with an annular ring 92 close to and paralleling opening 86 to prevent side movement of the hatch cover. Cover 88 is provided with an internal hinge arrangement consisting of a pair of bent or U-shaped rods 94 attached at one end to cover 88 and at the other end pivoted on plates 96 welded to the inside surfaces of dome 26. Thus it is seen that there are no exposed hinges on the outside of hatch cover 88. To lock hatch cover 88 in its closed position there is provided a conventional handle assembly 98 which locks when it is rotated in one direction and releases in the other direction. Such a device is known in the trade as a dog. On the underside of hatch cover 88 would be a fiberglass gasket (not shown) to make the shelter airtight.

A pair of eye bolts 102 and 104 threadably mounted on the outside of dome 26 and cover 88 adjacent each other permit the use of a lock from the outside when the shelter is not in use (no occupants inside). Eye bolts 102 and 104 are removed when occupants enter the shelter leaving nothing on the exposed dome 26 for attachment.

One or more sight ports 106 consisting of the opening and a pipe 108 welded to the dome and a threaded cap 112 on the inside may be employed. Two-spaced triangular openings 114 and 116 in dome 26 near ground level are provided as part of the air inlet/outlet system to be described. The triangular shape of these openings limits the danger that debris can be lodged in or block the openings.

If any debris falls on hatchcover 88 preventing it from being opened, a flat bar may be placed within module 14 across wall 56 to support a jack to permit hydraulic force to be employed for opening cover 88.

An important feature of this invention is the air inlet/-outlet system for the shelter. It is understood that the shelter would carry as part of its provisions tanks of compressed air along with CO and $CO^2$ sensors so that for short periods of time it has the ability to function without bringing in air from the outside. However, during most of the period that occupants are residing within the shelter it will be necessary, at regular intervals, to bring in fresh air and exhaust stale air. The air inlet/exhaust system not only accomplishes that function, but also includes blast valves to prevent dangerous, excessive pressure buildup within the shelter as a result of the pressure wave emanating from a blast and under pressure within the shelter due to drop in pressure below atmospheric following the shock wave. In addition, the air system is designed to filter out chemical, biological and radioactive components in the air which can be harmful to the occupants. The system, furthermore, is designed to thwart the efforts of would-be intruders attempting by the use of flammable liquids, water, smoke and other agents who may attempt to drive the occupants out of the shelter.

For a description of the air inlet/outlet system, reference is made to FIGS. 3 and 3*a*. It will be noted from FIG. 4, as previously described, that penetrating dome 26 near ground level are a pair of triangular openings 114 and 116. It will be seen from FIG. 3 that a manifold 118 communicates with inlet opening 114. Extending down from manifold 118 is a conduit 122 which contains a blast valve 124 and an "early filter" 126 both to be described later. A conduit 127 connects the outlet of early filter 126 to chemical, biological and radioactive (CBR) filter 128 from which a conduit 130 delivers the incoming air to side rail 76 of ladder assembly 72. Both filters are commercially available. The other end of side rail 76 terminates in horizontal section 82 at the entrance to cell 22. A manually operated air pump 134 is connected by hose 136 to the open end of section 82. Air pump 134 draws in fresh air and keeps cell 12 slightly pressurized. The horizontal extension of side rail 77 terminating at the entrance to cell 12 is connected by a hose 137 to draw in stale air at the top of cell where hose 137 terminates. As seen in FIG. 3*a*, the stale air travels up side rail 77 through a hose 142 into a manifold 144 connected to outlet opening 116. Within hose 142 is a blast valve 146.

Blast valves 124 and 146 are conventional valves which will open or close in response to small pressure differences of the order of 1 psi, just enough to permit the air flow system to operate. Inlet valve 124 is normally open and closes under a pressure in excess of 1 psi. Outlet valve 146 is normally closed and will open when the internal pressure of the shelter reaches 1 psi. These valves, known as wafer valves, are available commercially from Valvematic Valve Corp. and other companies in the industry.

A principal advantage of the air system just described as opposed to the conventional gooseneck usually employed in shelters is that the triangular air openings designed into the dome allow the air manifolds to be cleared in the event of saboteurs trying to clog the openings. The triangular openings prevent common objects from forming a tight fit if jammed into the opening of the air manifolds. In addition, flying debris cannot hit the air manifolds at a 90° angle of incidence which can result in severe damage.

Early filter 126 removes the coarser contaminants before entering the CBR filter 128, and may be replaced when it becomes too dirty. CBR filter 128 removes all contaminants such as chemical agents, biological agents, and radioactive iodine gas. An important feature of this invention is that the air filters are located away from the occupants who are in cell 12.

During fires on the ground above the shelter, the filters are removed to prevent their being damaged due to excessive heat. A heat shield can be employed to line the underside of dome 26 and hatch 88 to provide adequate time to remove the filters once the existence of a fire becomes known.

As previously mentioned, the occupants of shelter 10 normally reside in cell 12. As seen in FIG. 1, the latter is provided with a floor 152 made up of removable floor boards 154 supported by joists 155 so that the space 156 within containers 157 underneath can be employed for storage purposes. Water may be stored under containers 157. Cell 12 may be equipped with fiber-glass water tanks 160 lining the inside wall of cell 12 and supplies required for occupants to remain for at least 41 days and up to one year or more, using shelter 10 as living quarters when it is safe to leave the shelter for short periods of time. Water, food, medical supplies, radios, instruments such as devices to measure radioactivity, batteries, etc. would be contained within cell 12, as well as a manual flush up toilet 162 segregated by a wall 164 having a cutout 165 for access.

In existing shelter designs, air access is generally accomplished using a pipe extending up through the surface of the ground and terminating in an upside down U-configuration, or a gooseneck. Such an arrangement is considered unsatisfactory for several reasons. The presence of flying debris during a blast could shear off the top of the pipe or distort it so that a blockage will result. Also, it is accessible to intruders who can use the inlet to insert water or noxious fumes to gain access to force the residents to leave.

Instead of the gooseneck termination of an upright pipe, utilizing the principles of this invention the aforementioned problems can be minimized or avoided by utilizing a dome shaped configuration similar to the dome shape on top of the command module described above.

Figure 5:
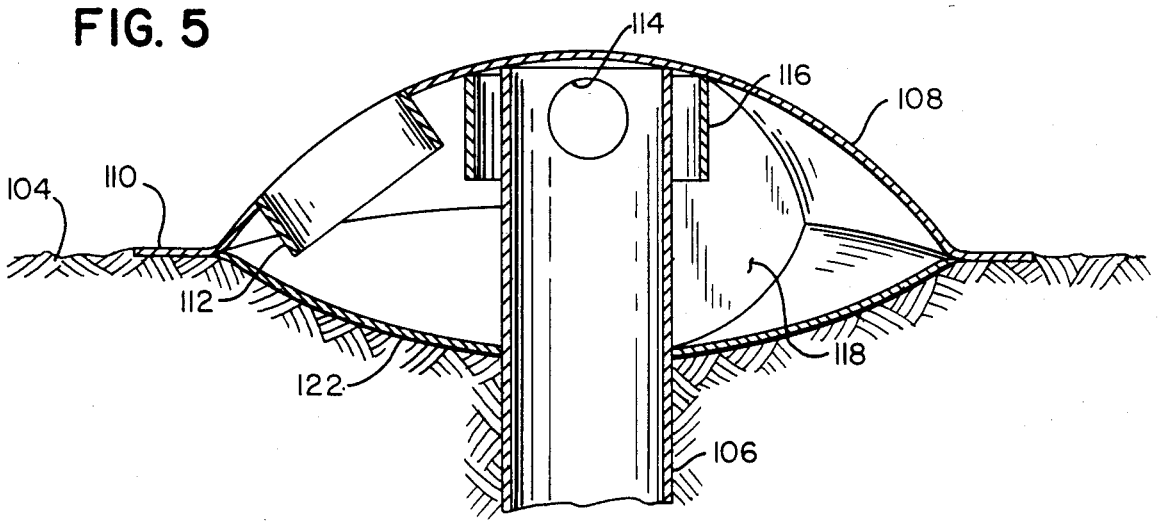
FIG. 5 is a view in section of a closure system for an air vent.

Referring to FIG. 5, there is shown vertically extending vent pipe 106 terminating a short distance above ground level 104. It will be seen that the top of pipe 106 is covered by an inverted saucer shaped dish or dome 108 secured to pipe 106 as illustrated and terminating in a flange 110 at ground level. Dome 108 is provided with an access port 112 extending inwardly. Adjacent the top opening of pipe 106 is a circular opening 114. Surrounding and spaced from the top of vent pipe 106 is a cylindrical sleeve 116 welded or otherwise secured at the top to the underside of dome 108. A so-called rope break consisting of a wall 118 extends from some convenient point on the circumference of tube 106 away from inlet port 112 to dome 108 to prevent the insertion through port 112 of a loop around tube 106 for pulling the assembly loose. An oppositely shaped dish 122 keeps the area under dome 108 dirt free.

In the arrangement just described it is seen that the dome shape would resist damage from flying debris and would-be intruders. Flooding is resisted by an air pocket at the top of pipe 106 by closing off any existing valves within the shelter.

It will be seen that the shelter as herein described is completely self-contained. For example, all piping, tanks, filters, and valves can be accessed within the shelter without ever having to go outside.

While only certain preferred embodiments of this invention have been described, it is understood that many variations are possible without departing from the principles of this invention as defined in the claims which follow.

What is claimed is:

1. An underground nuclear blast shelter comprising:

a. cell means below ground level containing living space for one or more occupants of said shelter;

b. underground command station means separated vertically and horizontally from said cell means having a dome at ground surface for providing access to said shelter, said dome being the only visible portion of said shelter;

c. means for providing communication between said command station means and said cell means including a vertical hollow shaft extending down from said command station means and a horizontal hollow shaft connecting said vertical shaft to said cell means;

d. said command station means including hatch means in said dome to provide said access and means for discharging waste products from said shelter; and e. flexing means in said vertical shaft to absorb a downward blast force on said dome.

2. The shelter of claim 1 wherein said cell means is provided with means adapted to be connected to cell means in another shelter.

3. The shelter of claim 1 in which said cell means is spherical in shape and is constructed out of fiber glass.

4. The shelter of claim 1 in which said hatch means consists of an opening in said dome and a hatch cover for closing said opening, and means supporting said hatch cover for movement between open and closed positions in which all supporting structure is contained within said command station means.

5. The shelter as recited in claim 1 having ladder means to facilitate physical movement between said cell means and said command station means extending through said hollow shaft means, said ladder means having spaced side rails and rungs between said side rails in said vertical shaft.

6. The shelter as recited in claim 5 having an air inlet-/exhaust system in which said side rails of said ladder means function as conduits for air flow between said command station means and said cell means.

7. The shelter of claim 6 having a cesspool surrounding and extending below said command station means for receiving liquid wastes from said cell means.

8. The shelter of claim 7 having vent means from said cesspool to said air inlet/exhaust system.

9. The shelter as recited in claim 6 in which said air inlet/exhaust system comprises air inlet and exhaust openings in said dome near said ground surface, air manifolds within said command station means in communication with said openings, conduit means connecting said air manifold means to said hollow side rails, and valve means within each of said conduit means for protecting the interior of said shelter from over and under pressures.

10. The shelter of claim 9 in which said air inlet/exhaust system further comprises in said conduit means between the air manifold for said air inlet opening and said ladder means early filter means to receive air from said inlet opening and CBR filter means to receive air from said early filter, and pump means within said cell means for providing suction for flow of inlet air and pressurizing said cell means, said early filter means removing the coarse contaminants in said inlet air, and said CBR filter means removing chemical agents, biological agents, and radioactive iodine gas.

11. The shelter of claim 9 wherein said inlet and exhaust openings are triangular shaped.

* * * * *